US010166543B2

(12) United States Patent
Lee et al.

(10) Patent No.: US 10,166,543 B2
(45) Date of Patent: Jan. 1, 2019

(54) CELL CAPTURING CARTRIDGE

(71) Applicants: Electronics and Telecommunications Research Institute, Daejeon (KR); GenoBio Corp., Seoul (KR)

(72) Inventors: Dae-Sik Lee, Daejeon (KR); Jeong Won Park, Daejeon (KR); Moon Youn Jung, Daejeon (KR); Do Hyung Kim, Seoul (KR); Jae Ku Lee, Gwangmyeong-si (KR); Hun Seok Lee, Seoul (KR)

(73) Assignees: Electronics and Telecommunications Research Institute, Daejeon (KR); GenoBio Corp., Seoul (KR)

( * ) Notice: Subject to any disclaimer, the term of this patent is extended or adjusted under 35 U.S.C. 154(b) by 2 days.

(21) Appl. No.: 15/432,671

(22) Filed: Feb. 14, 2017

(65) Prior Publication Data

US 2017/0266656 A1 Sep. 21, 2017

(30) Foreign Application Priority Data

Mar. 21, 2016 (KR) ..... 10-2016-0033515

(51) Int. Cl.
*B01L 3/00* (2006.01)

(52) U.S. Cl.
CPC ..... *B01L 3/508* (2013.01); *B01L 2200/0652* (2013.01); *B01L 2300/0809* (2013.01); *B01L 2300/0848* (2013.01)

(58) Field of Classification Search
None
See application file for complete search history.

(56) References Cited

U.S. PATENT DOCUMENTS 5,427,663 A * 6/1995 Austin ..... B01J 19/0093 204/450
6,468,531 B1 * 10/2002 Matthew ..... C07K 16/4241 424/131.1
8,475,730 B2 7/2013 Jeong
(Continued)

FOREIGN PATENT DOCUMENTS

KR 1020090007411 A 1/2009
KR 1020110037345 A 4/2011
KR 101252829 B1 4/2013

OTHER PUBLICATIONS

Minseok S. Kim et al., "A Trachea-Inspired Bifurcated Microfi Iter Capturing Viable Circulating Tumor Cells via Altered Biophysical Properties as Measured by Atomic Force Microscopy", small 2013, 9, No. 18, pp. 3103-3110.

*Primary Examiner* — Jill A Warden
*Assistant Examiner* — Brittany I Fisher
(74) *Attorney, Agent, or Firm* — William Park & Associates Ltd.

(57) ABSTRACT

Provided is a cell capturing cartridge. According to an embodiment of the inventive concept, the cell capturing cartridge may include a substrate and structures provided on an upper surface of the substrate and constituting a plurality of rows that are parallel to a row direction. The structures in one row may be offset from the structures in the neighboring rows in the row direction. Each of the substrates may have a first side surface facing one side of the substrate and a second side surface disposed opposite to the first side surface and having a width greater than that of the first side surface.

14 Claims, 12 Drawing Sheets

(56) References Cited

U.S. PATENT DOCUMENTS

| | | | | |
|---|---|---|---|---|
| 9,157,840 | B2 | 10/2015 | Cho et al. | |
| 2005/0106756 | A1* | 5/2005 | Blankenstein | B01L 3/502753 436/523 |
| 2005/0202733 | A1* | 9/2005 | Yoshimura | B01L 3/502746 439/839 |
| 2007/0238122 | A1 | 10/2007 | Allbritton et al. | |
| 2011/0082056 | A1 | 4/2011 | Park et al. | |
| 2012/0261356 | A1* | 10/2012 | Tsutsui | B01L 3/502761 210/767 |
| 2013/0129578 | A1 | 5/2013 | Jeong | |
| 2013/0210068 | A1* | 8/2013 | Yokoyama | C12Q 1/045 435/34 |
| 2013/0236885 | A1 | 9/2013 | Cho et al. | |
| 2013/0301105 | A1* | 11/2013 | Kim | G02B 26/005 359/290 |
| 2013/0302884 | A1 | 11/2013 | Fowler et al. | |
| 2014/0178900 | A1 | 6/2014 | Jung et al. | |
| 2014/0251666 | A1* | 9/2014 | Arai | C23C 18/1216 174/257 |
| 2014/0349867 | A1 | 11/2014 | Handique et al. | |

* cited by examiner

CELL CAPTURING CARTRIDGE

CROSS-REFERENCE TO RELATED APPLICATIONS

This U.S. non-provisional patent application claims priority under 35 U.S.C. § 119 of Korean Patent Application No. 10-2016-0033515, filed on Mar. 21, 2016, the entire contents of which are hereby incorporated by reference.

BACKGROUND

The present disclosure herein relates to a cell capturing device, and more particularly, to a structure of a cell capturing cartridge.

Nanobio-technology (NBT) that is a next-generation convergence technology deals with diagnosis and treatment of disease in human beings, and importance thereof is increasing. Especially, researches on biological cells such as a cancer cell have been increasing. A small amount of the biological cells may exist in a human body. Accordingly, capture and separation of a single biological cell is required. For the researches on biological cells, various devices for capturing and separating the biological cells have been developing. As the cell capturing device causes an electrical or optical signal variation from a captured cell, the cell may be quantitatively and qualitatively detected. The cell capturing device is required to have a simple structure to be mass-produced. In addition, the cell capturing device is required to increase in capturing rate.

SUMMARY

The present disclosure provides a cell capturing cartridge having an improved capturing efficiency and a micro cell capturing device including the same.

The object of the present invention is not limited to the aforesaid, but other objects not described herein will be clearly understood by those skilled in the art from descriptions below.

The present disclosure relates to a cell capturing cartridge. An embodiment of the inventive concept provides a cell capturing cartridge including: a lower substrate having one side, the another side disposed opposite to the one side, and an upper surface connecting the one side to the another side; a structure provided on the upper surface of the lower substrate and having a first side surface facing the one surface of the lower substrate and a second side surface disposed opposite to the first side surface and having a width greater than that of the first side surface; and an upper substrate provided on the structure. Here, the structure includes: first structures arranged in a first direction parallel to the one side of the lower substrate; and a second structure that is offset from one of the first structures in the first direction, and the first structures are disposed closer to the one side of the lower substrate than the second structure.

In an embodiment, the structure may include a capturing part recessed from the first side surface to the second side surface thereof.

In an embodiment, the first structures may have a passage therebetween, the capturing part of the second structure may be aligned with the passage in a second direction, and the second direction may cross the first direction.

In an embodiment, the structure may protrude from the lower substrate and include the same material as that of the lower substrate.

In an embodiment, the structure may protrude from the upper structure and include the same material as that of the upper substrate.

In an embodiment, the upper substrate may have an inlet opening at a first side thereof, and the first side of the upper substrate may overlap the one side of the lower substrate in view of a plane.

In an embodiment of the inventive concept, a cell capturing cartridge includes: a substrate; and structures provided on an upper surface of the substrate and constituting a plurality of rows that are parallel to a first direction. Here, the structures in one row are offset from the structures in the neighboring rows in the first direction, the substrate has one side parallel to a row direction and the another side disposed opposite to the one side, and the upper surface connects the one side to the another side, and each of the structures includes: a first side surface facing the one side of the substrate; and a second side surface disposed opposite to the first side surface and having a width greater than that of the first side surface.

In an embodiment, each of the structures may have a recessed part in the first side surface thereof.

In an embodiment, each of the structures may include a channel, and the channel may connect an inner surface of the recessed part to the second side surface.

In an embodiment, the recessed part may include: a first portion disposed adjacent to the first side surface; and a second portion connected to the first portion and having a width greater than that of the first portion.

In an embodiment, each of the structures may further include a capturing part on the second side surface, and the capturing part may be recessed from the second side surface to the first side surface.

In an embodiment, the structures in one of the rows may have a passage therebetween, the structures in the neighboring row may be aligned with the passage in a second direction, and the second direction may cross the first direction.

In an embodiment, a distance between two neighboring rows of the rows may be different from that between other two neighboring rows.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
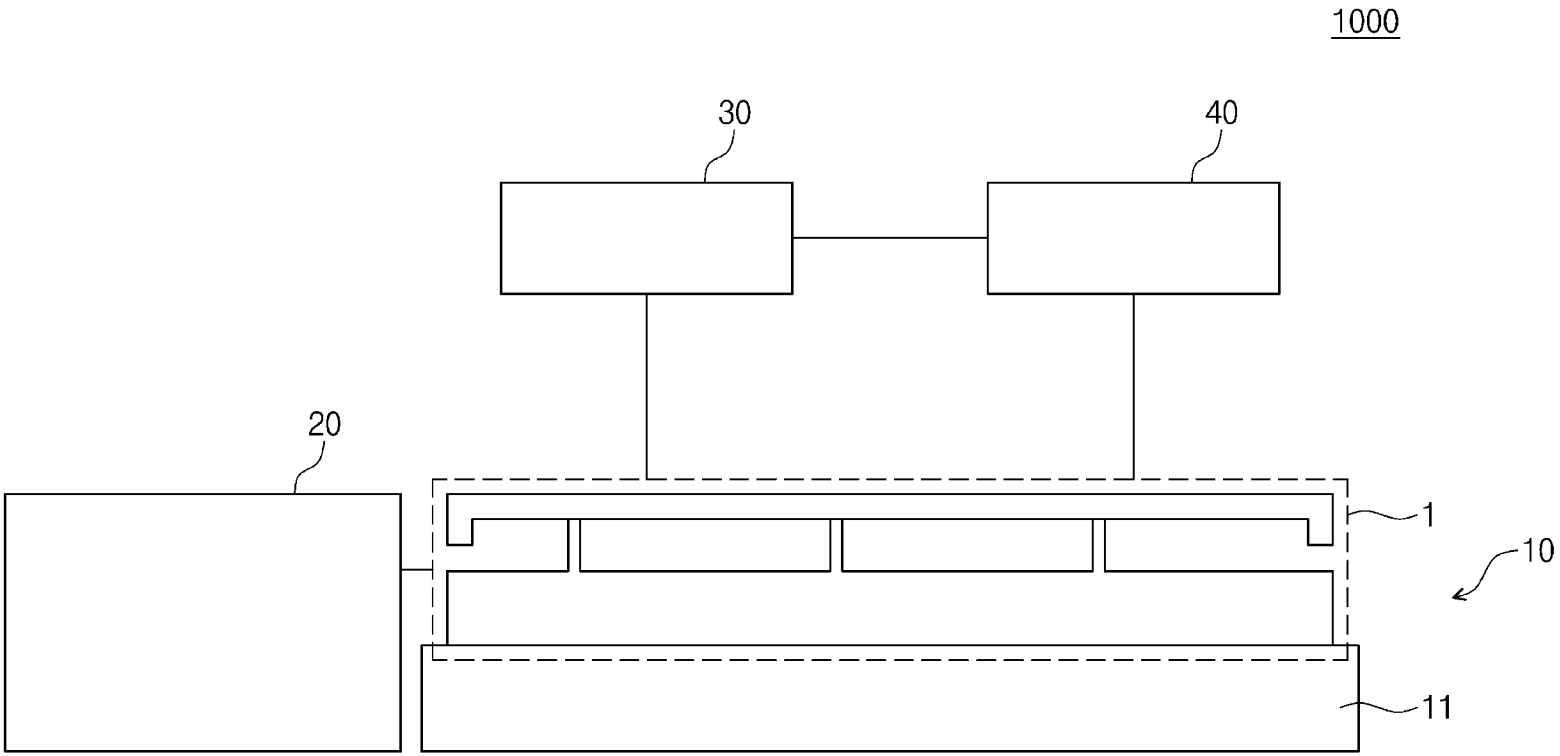
FIG. 1 is a mimetic diagram of a cell capturing device according to an embodiment of the inventive concept.

Hereinafter, preferred embodiments of the inventive concept will be described below in detail with reference to the accompanying drawings. Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

In the following description, the technical terms are used only for explaining a specific exemplary embodiment while not limiting the present disclosure. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components. Since preferred embodiments are provided below, the order of the reference numerals given in the description is not limited thereto. In the specification, it will be understood that when a layer (or film) is referred to as being 'on' another layer or substrate, it can be directly on the other layer or substrate, or intervening layers may also be present.

Also, though terms like a first, a second, and a third are used to describe various elements (or structures) in various embodiments of the present invention, the elements and the structures are not limited to these terms. The terms are used only to distinguish an element (or structure) from another. Therefore, a structure referred to as a first structure in one embodiment can be referred to as a second structure in another embodiment. An embodiment described and exemplified herein includes a complementary embodiment thereof. Like reference numerals refer to like elements throughout.

Additionally, the embodiment in the detailed description will be described with sectional views as ideal exemplary views of the present invention. In the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. For example, an etched region having a right angle illustrated in the drawings may have a round shape or a shape having a predetermined curvature. Areas exemplified in the drawings have general properties, and are used to illustrate a specific shape of a semiconductor package region. Thus, this should not be construed as limited to the scope of the present invention.

According to the concept of the present disclosure, a cell capturing cartridge and a cell capturing device using the same will be described.

FIG. 1 is a mimetic diagram of a cell capturing device according to an embodiment of the inventive concept.

Referring to FIG. 1, a cell capturing device 1000 may include a sample fixing unit 10, a sample supply unit 20, a light source unit 30, and a sensing unit 40. The cell capturing device 1000 may capture or detect a single cell. The cell may include a biological cell such as a cancer cell. The cell may have a micro diameter, e.g., a mean diameter of about 1 μm to about 20 μm.

The sample fixing unit 10 may include a plate 11. A cell capturing cartridge 1 may be inserted onto the plate 11. The cell capturing cartridge 1 may be a disposable cartridge that is detachably provided on the plate 11.

The sample supply unit 20 may be disposed adjacent to the sample fixing unit 10. The sample supply unit 20 may provide a cell sample to the sample fixing unit 10. The cell sample may include a cell and a solvent.

The light source unit 30 may be spaced apart from the cell capturing cartridge 1 above the sample fixing unit 10. The light source unit 30 may provide light to a cell captured by the cell capturing cartridge 1 of the sample fixing unit 10. For example, light having a first wavelength may be irradiated on the cell capturing cartridge 1. The cell may absorb the light having the first wavelength, which is irradiated from the light source unit 30, to emit light having a second wavelength. The second wavelength may be different from the first wavelength.

The sensing unit 40 may be provided adjacent to the sample fixing unit 10. The sensing unit 40 may detect the light having the second wavelength, which is emitted from the cell captured by the cell capturing cartridge 1.

Figure 2A:
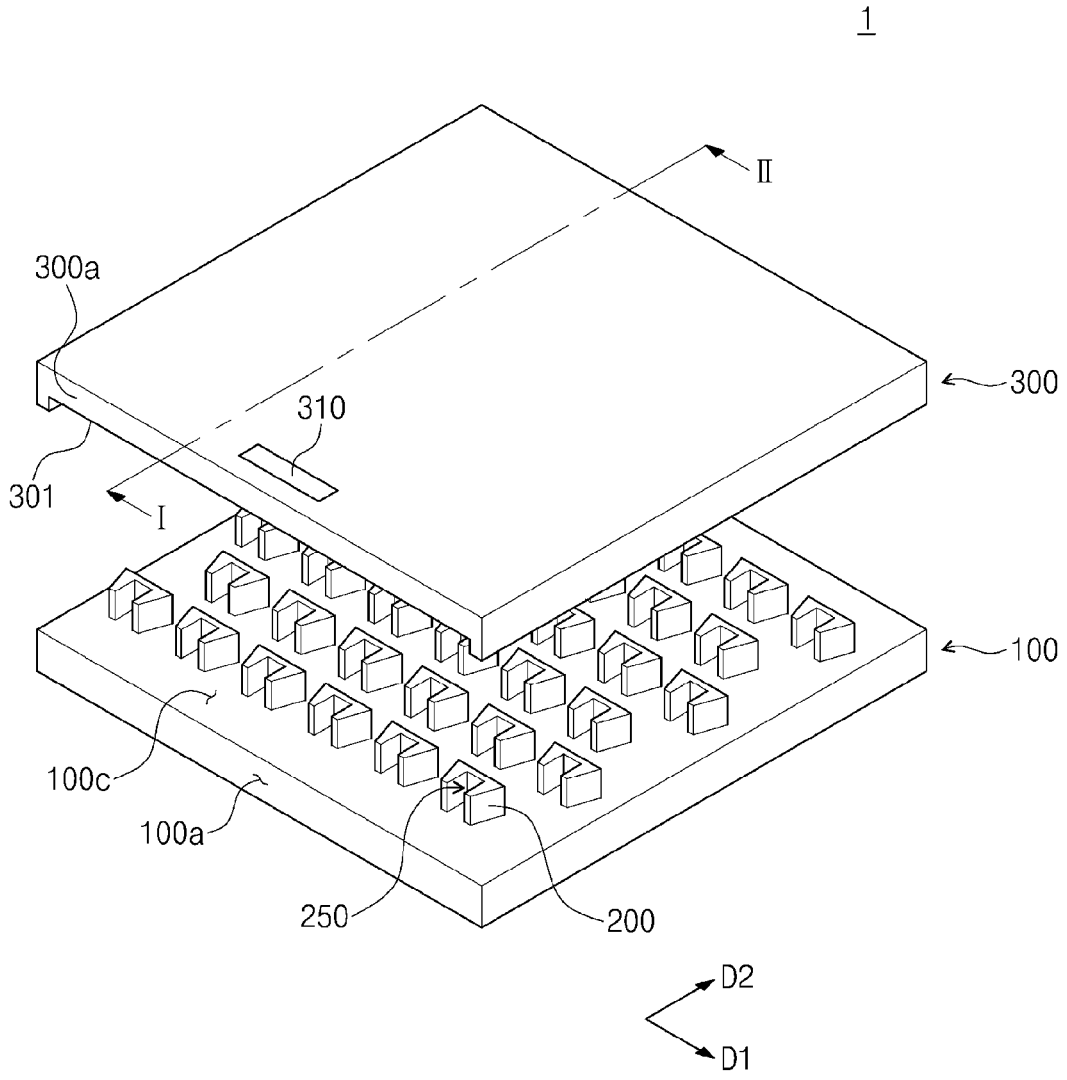
FIG. 2A is an exploded perspective view of the cell capturing cartridge according to an embodiment of the inventive concept.
Figure 2B:
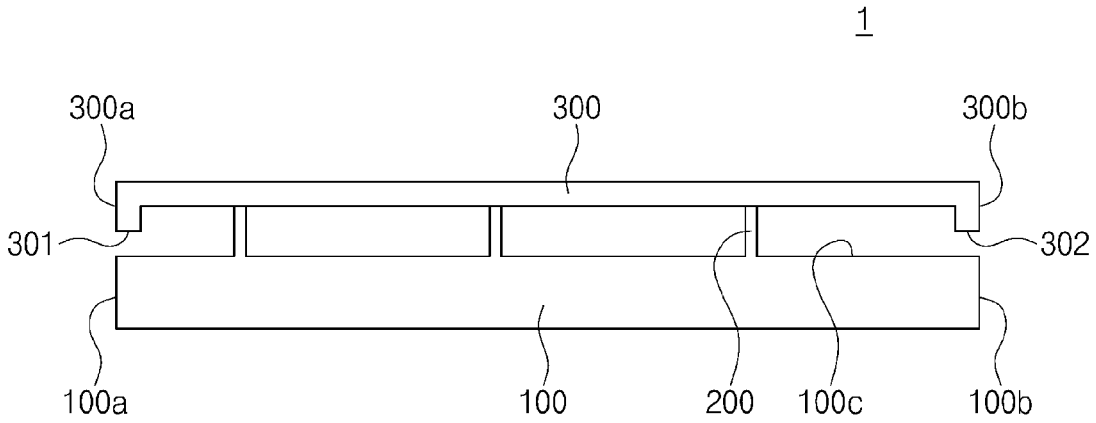
FIG. 2B is a cross-sectional view taken along line I-II of FIG. 2A.

FIG. 2A is an exploded perspective view of the cell capturing cartridge according to embodiments of the inventive concept. FIG. 2B is a cross-sectional view taken along line I-II of FIG. 2A. Hereinafter, the duplicated descriptions, which have been described already, will be omitted.

Referring to FIGS. 2A and 2B, the cell capturing cartridge 1 may include a lower substrate 100, structures 200, and an upper substrate 300. The lower substrate 100 may have one side 100*a*, the another side 100*b*, and a top surface 100*c*. The one side 100*a* of the lower substrate 100 may be parallel to a first direction D1 and face the sample supply unit 20 in FIG. 1. The another side (refer to reference numeral 100*b* in FIG. 2B) of the lower substrate 100 may be disposed opposite to the one side 100*a*, and the top surface 100*c* may connect the one side 100*a* to the another side 100*b*. The lower substrate 100 may include an inorganic material such as glass and silicon. For another example, the lower substrate 100 may include a polymer.

At least three structures 200 may be provided on the lower substrate 100. The structures 200 may include capturing parts 250, respectively. As illustrated in FIG. 2B, the structures 200 may be provided in one united body with the lower substrate 100. For example, the structures 200 may be a portion of the lower substrate 100, which protrudes from the top surface 100*c* of the lower substrate 100 toward the upper substrate 300. The structures 200 may be connected to the lower substrate 100 and include the same material as that of the lower substrate 100.

The upper substrate 300 may be provided on the structures 200. An inlet opening may be defined in a first side 300*a* of the upper substrate 300. The first side 300*a* of the upper substrate 300 may overlap the one side 100*a* of the lower substrate 100 in terms of a plane. An inlet marker 310 may be provided adjacent to the first side 300*a* on a top surface of the upper substrate 300. In FIG. 2A, the inlet marker 310 may be a character or a figure provided on the top surface of the upper substrate 300. For another example, the inlet marker 310 may be provided on the first side 300*a* of the upper substrate 300. As illustrated in FIG. 2B, an outlet opening 302 may be defined in a second side 300*b* of the upper substrate 300. The second side 300*b* of the upper substrate 300 may face the first side 300*a*. The cell sample may be provided on the top surface 100*c* of the lower substrate 100 through the inlet opening 301 and discharged from the cell capturing cartridge 1 through the outlet opening 302. The upper substrate 300 may include a polymer such as polydimethylsiloxane (PDMS), polymethyl methacrylate (PMMA), polyimide (PI), polycarbonate (PC), or cyclo olefin copolymer (COC).

Figure 2C:
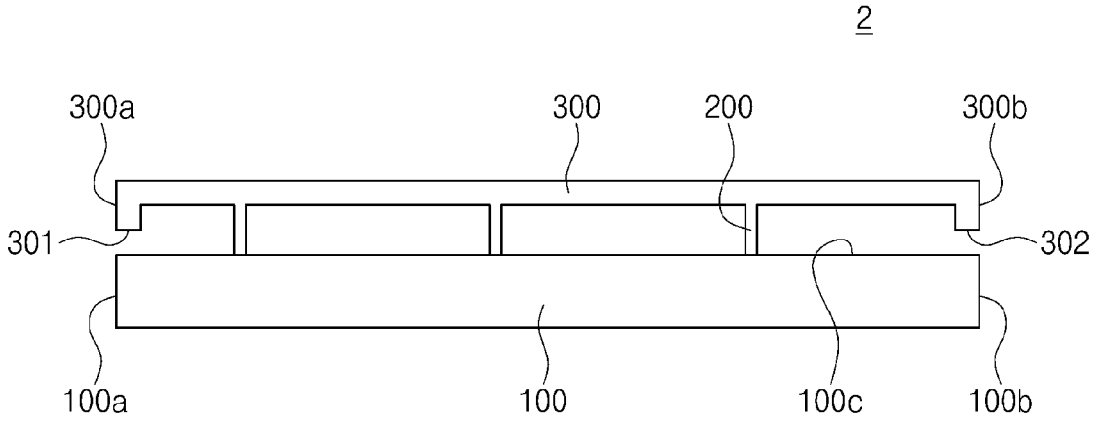
FIG. 2C is a cross-sectional view of the cell capturing cartridge according to another embodiment of the inventive concept.

FIG. 2C is a cross-sectional view of a cell capturing cartridge according to another embodiment of the inventive concept and corresponds to a cross-section taken along line I-II of FIG. 2A. Hereinafter, the duplicated descriptions, which have been described already, will be omitted.

Referring to FIG. 2C, the structures 200 may be provided in one united body with the lower substrate. For example, the structures 200 may be a portion of the upper substrate 300, which protrudes from a bottom surface of the upper substrate 300 toward the lower substrate 100. Each of the structures 200 may include the same material as that of the upper substrate 300.

For another example, the structures 200 may not be provided in the one united body with the lower substrate 100 or the upper substrate 300. That is, the structures 200 may be manufactured separately from the lower substrate 100 or the upper substrate 300.

Figure 3:
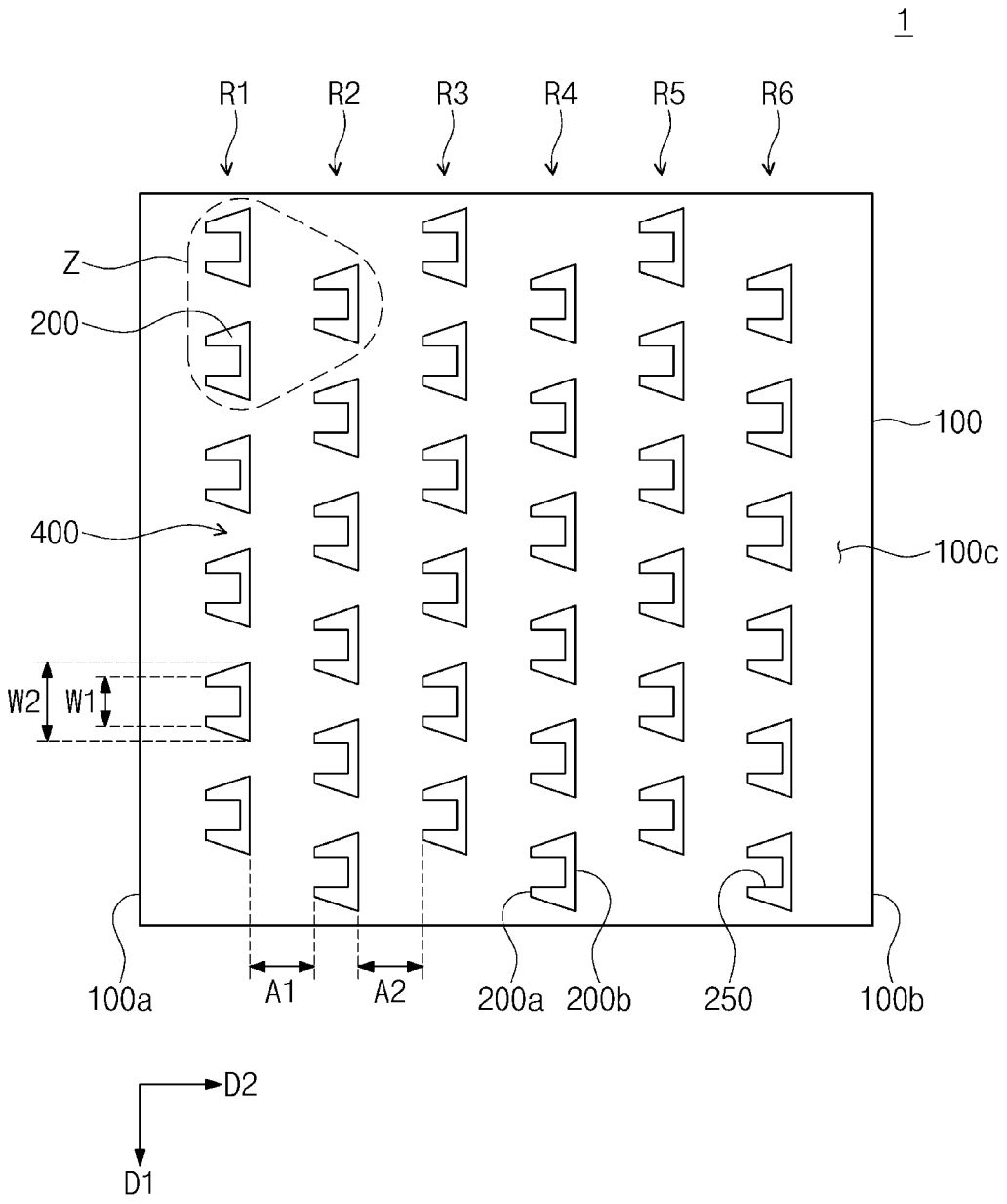
FIG. 3 is a plan view of the cell capturing cartridge according to an embodiment of the inventive concept.
Figure 4:
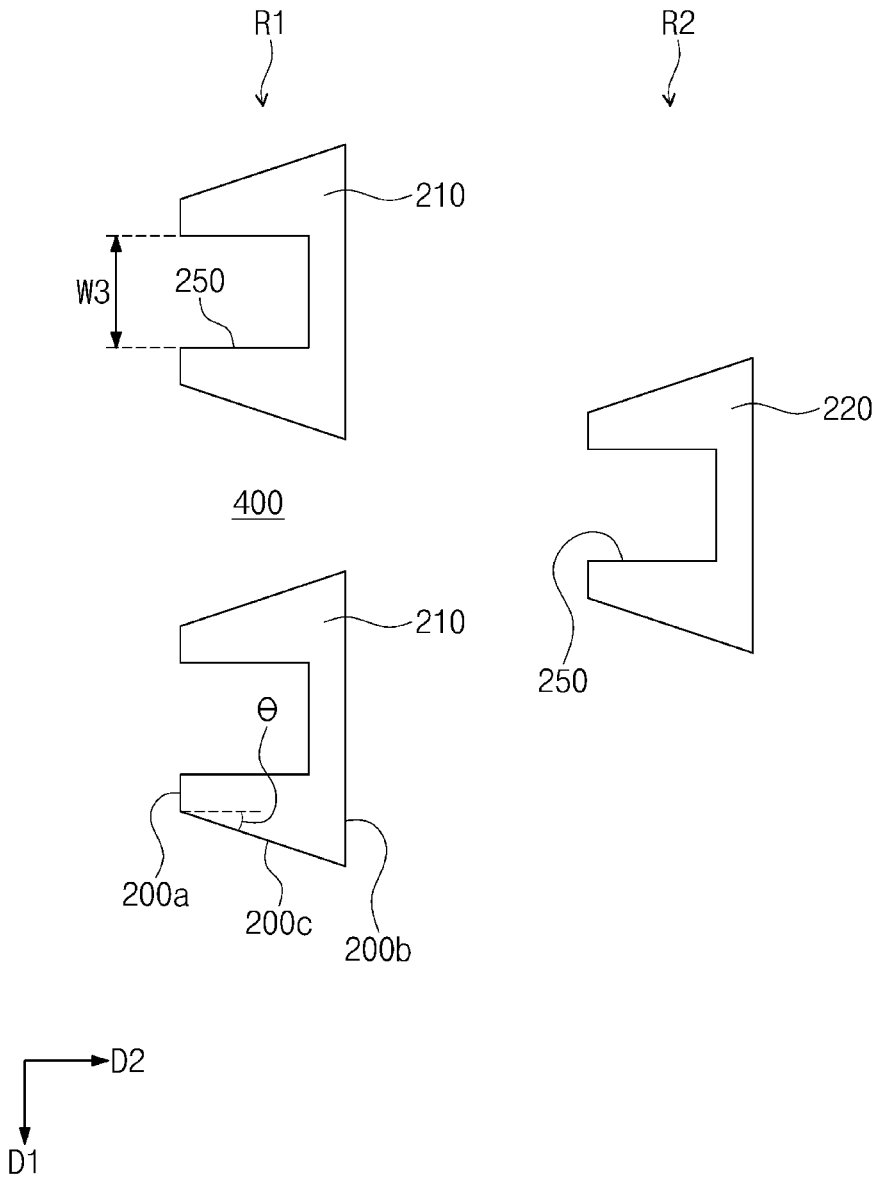
FIG. 4 is an enlarged view of a region Z of FIG. 3.

FIG. 3 is a plan view illustrating the cell capturing cartridge according to an embodiment of the inventive concept and corresponds to a plane of the cell capturing cartridge of FIG. 2A. FIG. 4 is an enlarged view of a region Z of FIG. 3. Hereinafter, the duplicated descriptions, which have been described already, will be omitted.

Referring to FIG. 3, the cell capturing cartridge 1 may include the lower substrate 100, the structures 200, and the upper substrate 300. The structures 200 may be provided on the top surface 100*c* of the lower substrate 100. The structures 200 may be arranged along a plurality of rows R1, R2, R3, R4, R5, and R6. The rows R1, R2, R3, R4, R5, and R6 may be parallel to the first direction D1. At least one of the rows R1, R2, R3, R4, R5, and R6 may include a plurality of structures 200. In this case, passages 400 may be provided between the structured of the row. Each of the passages 400 may extend along a second direction D2. The second direction D2 may cross the first direction D1. Unlike the illustration, one of the rows R1, R2, R3, R4, R5, and R6 may include a single structure. The rows R1, R2, R3, R4, R5, and R6 and the structures 200 may not be limited to the illustration and may be variously provided in number.

The structures 200 constituting one of the rows R1, R2, R3, R4, R5, and R6 may be offset from the structures 200 constituting another row disposed adjacent thereto in the first direction D1, respectively. For example, the structures 200 in a second row R2 may be offset a distance of ½ of a mean distance between central points of the structures 200 in a first row R1 in the first direction D1. The first row R1 may be defined as a row disposed adjacent to the one side 100*a* of the upper substrate 300. The rows R1, R2, R3, R4, R5, and R6 may be spaced a predetermined distance from each other. A distance between two rows disposed adjacent to each other may be equal to that between other two rows disposed adjacent to each other. For example, a distance A1 between the first row R1 and the second row R2 may be equal to a distance A2 between the second row R2 and a third row R3. In this specification, a distance between rows may represent a distance between the structures 200 constituting the rows. The structures 200 in odd-numbered rows R1, R3, and R5 may be aligned with each other in the second direction D2. For example, the structures 200 in the third row R3 may be aligned with the structures 200 in the first row R1 in the second direction D2, respectively. The structures 200 in even-numbered rows R2, R4, and R6 may be aligned with each other in the second direction D2.

Each of the structures 200 may have first side surfaces 200*a* and second side surfaces 200*b*. The first side surfaces 200*a* of the structures 200 may face the one side 100*a* of the lower substrate 100. The second side surfaces 200*b* may be disposed opposite to the first side surfaces 200*a*. Each of the first side surfaces 200*a* of the structures 200 may have a width W1 less than a width W2 of each of the second side surfaces 200*b* thereof. In this specification, the width may be a value measured in a direction parallel to the first direction D1. The width W1 of each of the first side surfaces 200*a* of the structures 200 may be about 10 μm to about 15 μm, and the width W2 of each of the second side surfaces 200*b* may be 16 μm to 30 μm. The structures 200 may have capturing parts 250, respectively. The capturing parts 250 may be provided to the first side surfaces 200*a* of the structures, respectively. Each of the capturing parts 250 may be recessed from the first side surface 200*a* to the second side surface 200*b*. Referring to FIG. 4, the structures 200 will be described in more detail.

Referring to FIG. 4 together with FIG. 3, the structures 200 may include first structures 210 and a second structure 220. The first structures 210 may be arranged in the first direction D1 and constitute the first row R1. The passage 400 may be provided between the first structures 210. The second structure 220 may constitute the second row R2. The second structure 220 may be aligned with a first passage 410 in the second direction D2.

In view of a plane, the first structures 210 may have third side surfaces 200*c* connecting the first side surfaces 200*a* to the second side surfaces 200*b*. An angle θ at which each of the third side surfaces 200*c* is angled with respect to the second direction D2 may be greater than about 0° and less than about 90°. Each of the capturing parts 250 may have a width W3 greater than a diameter of each of the cells. For example, the width W3 of the capturing parts 250 may be 6 μm to 20 μm. The second structure 220 may have the same planar shape as that of each of the first structures 210.

Referring to FIG. 4 again, the capturing parts 250 of the structures 200 in the second row R2 may be aligned with the passages 400 between the structures 200 in the first row R1 in the second direction, respectively. Likewise, the capturing parts 250 in the third row R3 may be aligned with the passages 400 in the second row R2 in the second direction, respectively.

Figure 5:
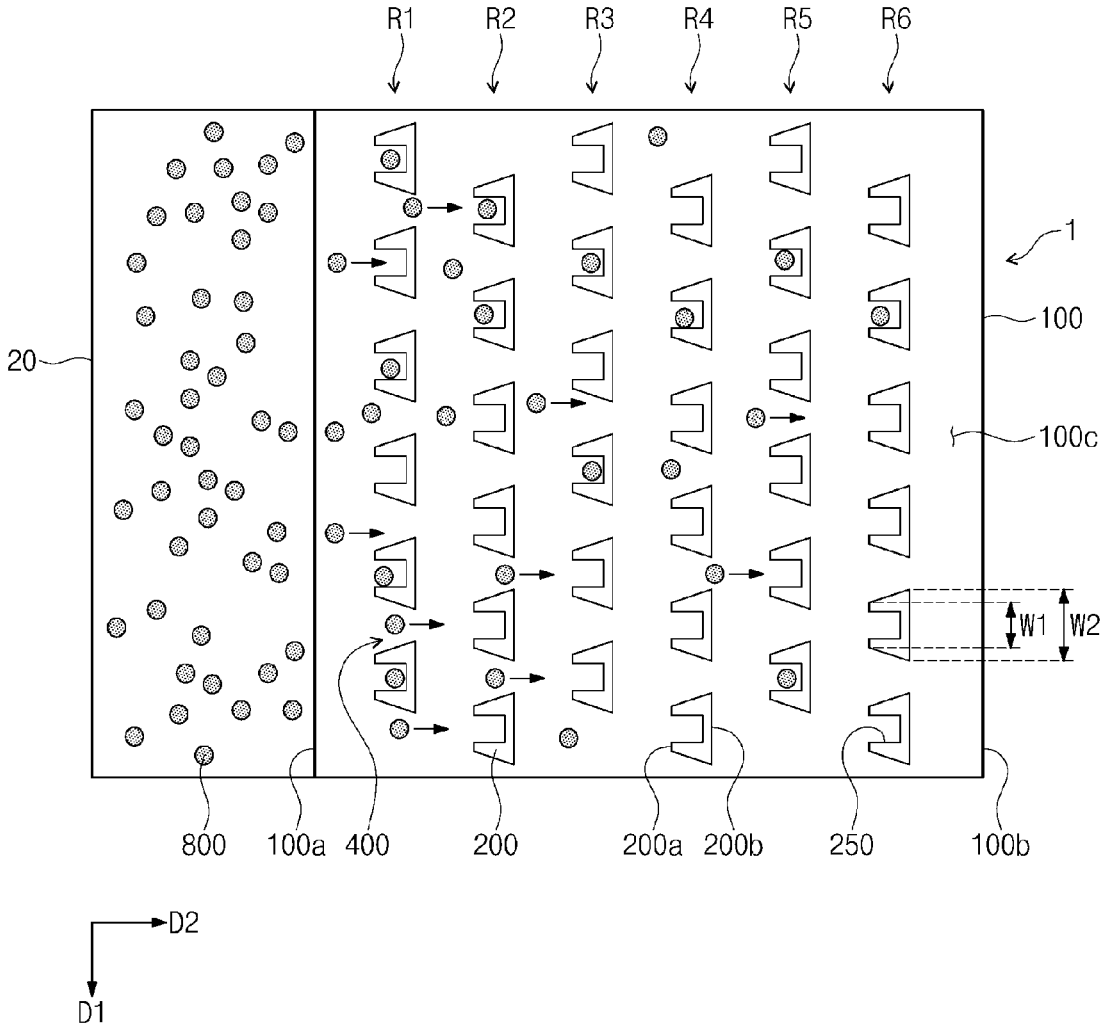
FIG. 5 is a plan view for explaining a cell capturing method according to an embodiment of the inventive concept.

FIG. 5 is a view for explaining a cell capturing method according to an embodiment of the inventive concept and a plan view of a portion of the cell capturing device.

Referring to FIG. 5 together with FIG. 1, the cell capturing cartridge 1 may include at least three structures 200 provided on the lower substrate 100. The cell capturing cartridge 1 may be the same as the cell capturing cartridge 1 described in FIG. 3. Although not shown, the upper substrate 300 may be further provided on the structures 200. The cell capturing cartridge 1 may be inserted into the sample fixing unit 10 of the cell capturing device 1000 of FIG. 1. Here, the one side 100*a* of the lower substrate 100 may be disposed to face the sample supply unit 20. A cell sample may be provided from the sample supply unit 20 onto the top surface 100*c* of the lower substrate 100. The cell sample may flow from the one side 100*a* to the another side 100*b* of the lower substrate 100 on the top surface 100*c* of the lower substrate 100 in the second direction D2. The capturing parts 250 of the structures 200 may be disposed to face the sample supply unit 20. A portion of cells 800 may be captured by the capturing parts 250 of the structures 200 in the first row R1. Another portion of the cells 800 may flow through the passages 400 in the first row R1. The structures 200 in the second row R2 may be aligned with the passages 400 in the first row R1 in the second direction D2, respectively. The capturing parts 250 of the structures 200 in the second row R2 may face the passages 400 in the first row R1. Accordingly, the capturing parts 250 in the second row R2 may capture the cells 800 passing through the passages 400 in the first row R1 with high probability. Since the width W2 of each of the second side surfaces 200*b* of the structures 200 is greater than the width W1 of each of the first side surfaces 200*a* thereof, each of outlets of the passages 400 may have a width smaller than that of each of inlets thereof. Here, each of the outlets of the passages 400 represents a portion between the structures 200, which is disposed in a line with the second side surfaces 200*b* of the structures 200 in the first direction D1. The cells 800 passing through the outlets of the passages 400 in the first row R1 may be concentrated to the capturing parts 250 in the second row R2. Accordingly, the capturing parts 250 in the second row R2 may capture the cells 800 with higher probability. Flow velocity of the cell sample may increase from the inlets to the outlets of the passages 400. Likewise, the capturing parts 250 in the third row R3 may capture the cells 800 passing through the passages 400 in the second row R2 with high probability. Thus, the cell capturing cartridge 1 according to an embodiment of the inventive concept may have a high cell capturing rate.

Figure 6:
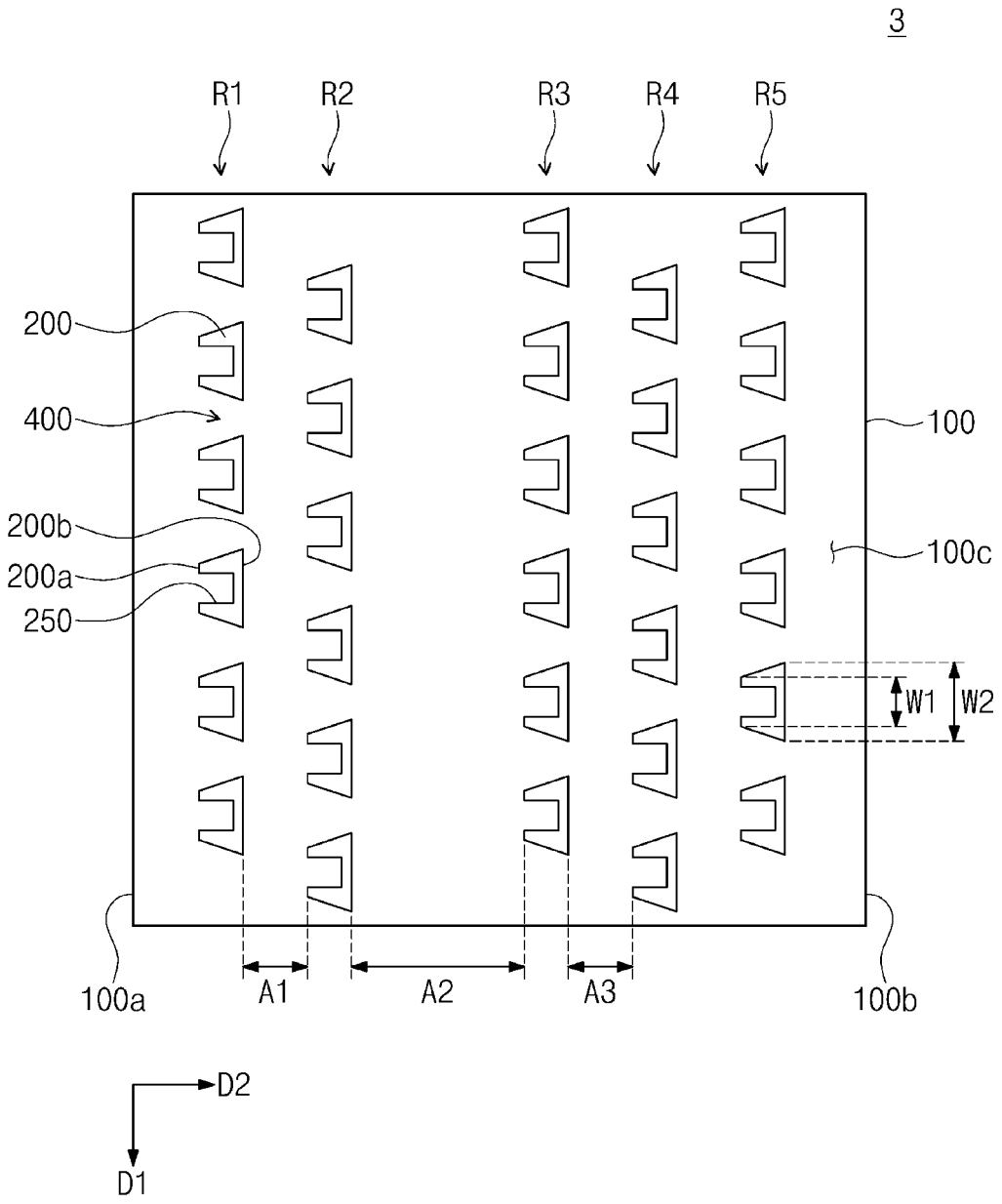
FIG. 6 is a cross-sectional view of a cell capturing cartridge according to another embodiment of the inventive concept.

FIG. 6 is a cross-sectional view of a cell capturing cartridge according to another embodiment of the inventive concept. Hereinafter, the duplicated descriptions, which have been described already, will be omitted.

Referring to FIG. 6, the cell capturing cartridge 1 may include the lower substrate 100 and the structures 200. The structures 200 may be provided on the top surface 100*c* of the lower substrate 100. The structures 200 may be arranged along the plurality of rows R1, R2, R3, R4, R5, and R6. The structures 200 constituting one of the rows R1, R2, R3, R4, R5, and R6 may be offset from the structures 200 constituting another row disposed adjacent thereto in the first direction D1.

Distances between the rows R1, R2, R3, R4, R5, and R6 may be various. A distance between two rows disposed adjacent to each other may be different from that between other two rows disposed adjacent to each other. For example, a distance A1 between the first row R1 and the second row R2 may be different from a distance A2 between the second row R2 and the third row R3. On the other hand, a distance between the structures 200 constituting two rows disposed adjacent to each other may be equal to that between other two rows disposed adjacent to each other. The distance A1 between the first row R1 and the second row R2 may be equal to a distance A3 between the third row R3 and the fourth row R4.

Each of the first side surfaces 200*a* of the structures 200 may have the width W1 less than the width W2 of each of the second side surfaces 200*b* thereof. The capturing parts 250 in an n+1-th row may be aligned with the passages 400 in an n-th row in the second direction D2, respectively (here, n is a natural number).

Figure 7A:
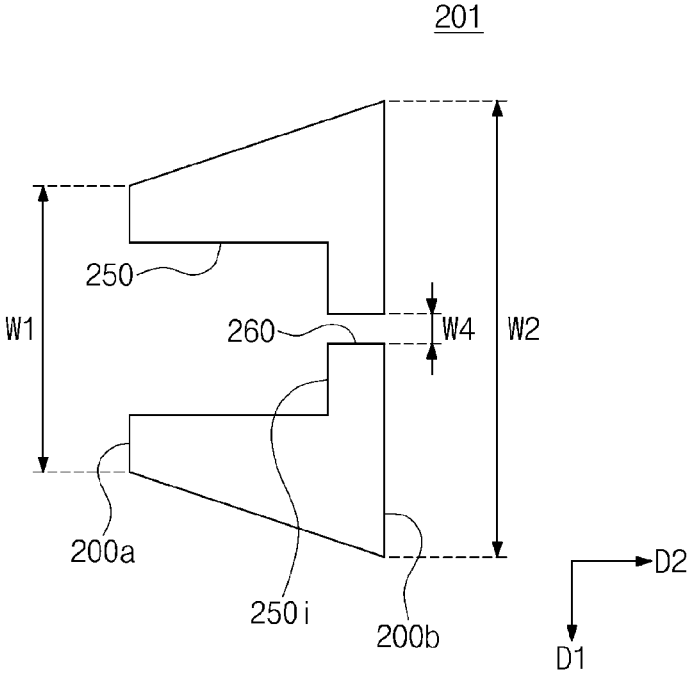
FIGS. 7A to 7C are cross-sectional views respectively illustrating structures according to another embodiment of the inventive concept.
Figure 7B:
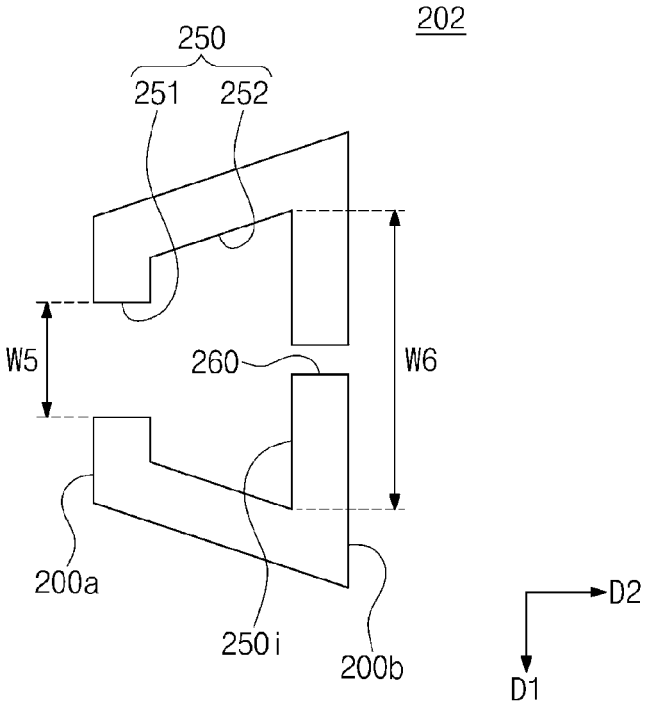
Figure 7C:
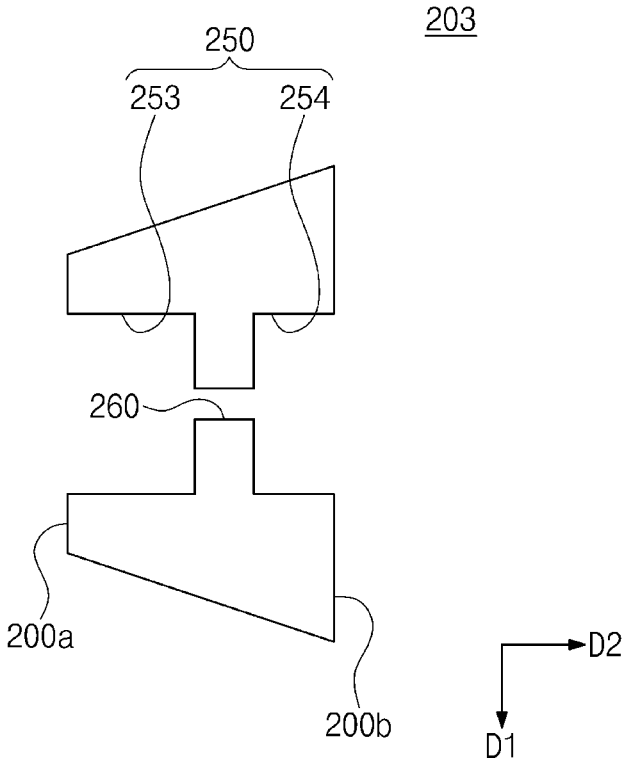

FIGS. 7A to 7C are cross-sectional views respectively illustrating structures according to another embodiments. Hereinafter, the duplicated descriptions, which have been described already, will be omitted.

Referring to FIGS. 7A to 7C together with FIG. 3, each of structures 201, 202, and 203 may have a first side surface 200*a* and a second side surface 200*b*. The first side surface 200*a* of each of the structures 201, 202, and 203 may face the one side 100*a* of the lower substrate 100. The second side surface 200*b* may have the width W2 greater than the width W1 of the first side surface 200*a*. The capturing part 250 may be provided to the first side surface 200*a* of each of the structures 201, 202, and 203. Each of the structures 201, 202, and 203 may have a channel 260 therein. The channel 260 may extend in the second direction D2 to pass through the structures 201, 202, and 203 in terms of a plane. For example, the channel 260 may connect an inner side surface 250*i* of the capturing part 250 to a second side surface 200*b* of each of the structures 201, 202, and 203. When a solvent of the cell sample is excessively provided in the capturing part 250, vortex of the solvent may be formed in the capturing part 250. For example, the solvent may flow from the capturing part 250 in a direction opposite to the second direction D2. Here, the cell may be discharged from the capturing part 250 together with the solvent by the vortex. According to an embodiment, the solvent may be discharged from the capturing part 250 through the channel 260. Generation of the vortex caused by the solvent may be reduced by the channel 260. The cells provided to the capturing part 250 may not pass through the channel 260. Accordingly, loss of the cell captured by the structures 201, 202, and 203 may be prevented or reduced. The channel 260 may have a width W4 less than a mean diameter of the cells. For example, the width W4 of the channel 260 may be about 0.5 μm to about 8 μm. The width W4 of the channel 260 may be adjusted according to the mean diameter of the cells.

Referring to FIG. 7B, the capturing part 250 may include a first portion 251 and a second portion 252. The first portion 251 of the capturing part 250 may have a width W5 less than a width W6 of the second portion 252. Here, the first portion 251 of the capturing part 250 may be disposed adjacent to the first side 200*a* of the structure 202. For example, the width W5 of the first portion 251 of the capturing part 250 may be about 6 μm to about 20 μm. The width W6 of the second portion 252 may be about 10 μm to about 25 μm. The second portion 252 of the capturing part 250 may be connected to the first portion 251. According to embodiments, although the vortex caused by the solvent in the cell sample is provided, the cell may be favorably fixed to the second portion 252 of the capturing part 250. For another example, the channel 260 may be omitted.

Referring to FIG. 7C together with FIG. 3, the structure 203 may include a first capturing part 253 and a second capturing part 254. The first capturing part 253 may be provided to the first side surface 200*a* of the structure 203, and the second capturing part 254 may be provided to the second side surface 200*b* of the structure 203. The vortex of the solvent may be generated by a structure (not shown) in a row adjacent to the second side surface 200*b* of the structure 203. The cell may flow from the structure (not shown) in the adjacent row toward the second capturing part 254 by the vortex. The cell moving by the vortex may be fixed by the second capturing part 254. The channel 260 may connect the first capturing part 253 to the second capturing part 254. For another example, the channel 260 may be omitted.

FIGS. 8A to 8D are cross-sectional views illustrating a process of manufacturing the cell capturing cartridge according to embodiments, each of which corresponds to a cross-section taken along line I-II of FIG. 2A.

Figure 8A:
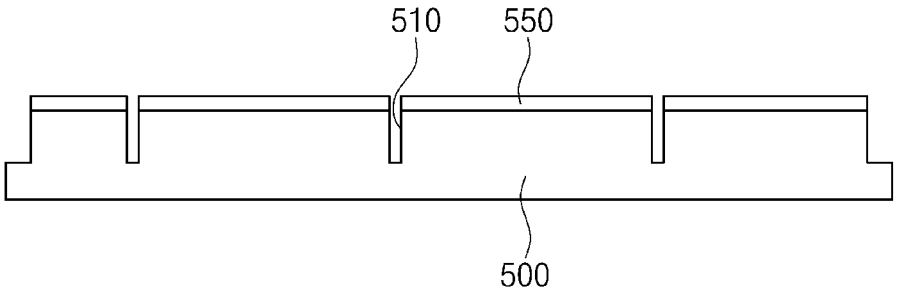
FIGS. 8A to 8D are cross-sectional views illustrating a process of manufacturing the cell capturing cartridge according to an embodiment of the inventive concept.

Referring to FIG. 8A, a mask pattern 550 may be formed on a mold 500. The mold 500 may include metal, silicon, or a polymer. The mold 500 may be etched by using the mask pattern 550. Accordingly, recessed parts 510 may be formed in the mold 500. Thereafter, the mask pattern 550 may be removed.

Figure 8B:
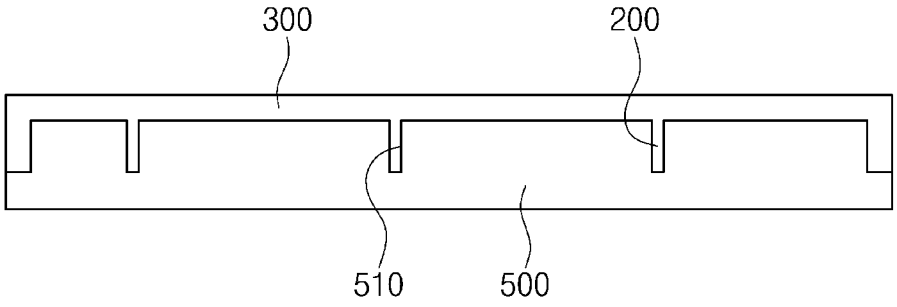

Referring to FIG. 8B, the upper substrate 300 and the structures 200 may be formed on the mold 500. For example, the polymer is provided on the mold 500 and filled into the recessed parts 510. The polymer may include polydimethylsiloxane (PDMS), polymethyl methacrylate (PMMA), polyimide (PI), polycarbonate (PC), or cyclo olefin copolymer (COC). The polymer is cured to form the upper substrate 300 and the structures 200. Like a bolt and a nut, each of the structures 200 may have a shape corresponding to each of the recessed parts 510. The structures 200 may be the same as that described in FIG. 2C. For example, the structures 200 and the upper substrate 300 may form one united body. The structures 200 may have an arrangement that is the same as that in FIG. 3 or 5. Each of the structures 200 may have the same shape as that in FIG. 4, 7A, 7B, or 7C. Thereafter, the upper substrate 300 may be separated from the mold 500.

Figure 8C:
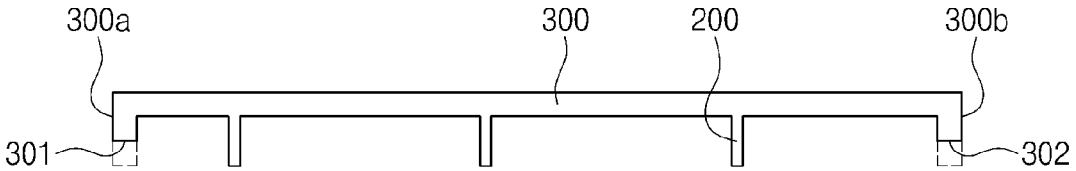

Referring to FIG. 8C, the inlet opening 301 and the outlet opening 302 may be formed in the first side 300*a* and the second side 300*b* of the upper substrate 300, respectively. The inlet opening 301 and the outlet opening 302 may be formed by a drilling or a punching process.

Figure 8D:
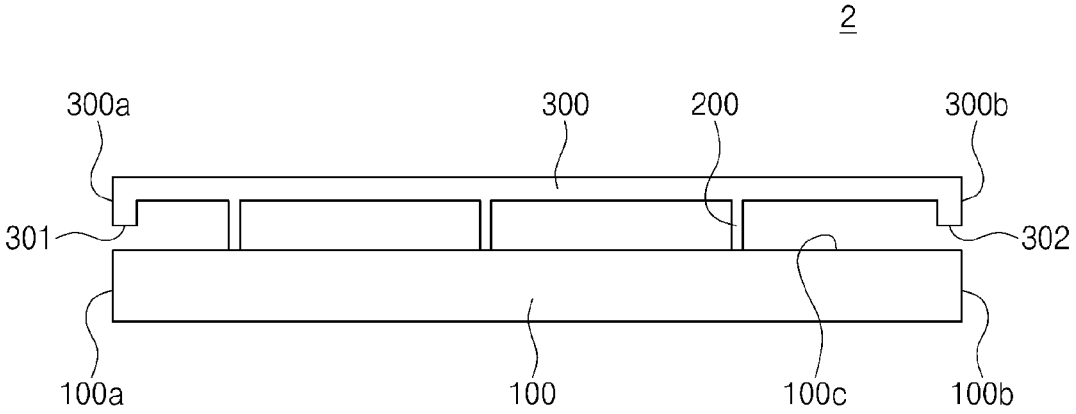

Referring to FIG. 8D, the lower substrate 100 may be provided. The upper substrate 300 may be aligned on the lower substrate 100 so that the structures 200 face the lower substrate 100. Here, the upper substrate 300 of FIG. 8C may be used. The process of manufacturing the cell capturing cartridge 2 of FIG. 2*c* may be completed through the manufacturing example described above.

FIGS. 9A to 9D are cross-sectional views illustrating a process of manufacturing the cell capturing cartridge according to another embodiment, each of which corresponds to a cross-section taken along line I-II of FIG. 2A. Hereinafter, the duplicated descriptions, which have been described already, will be omitted.

Figure 9A:
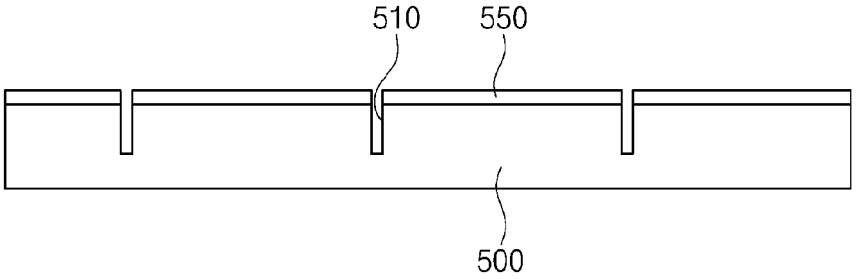
FIGS. 9A to 9C are cross-sectional views illustrating a process of manufacturing the cell capturing cartridge according to another embodiment of the inventive concept.

Referring to FIG. 9A, recessed parts 510 may be formed in a mold 500. The recessed parts 510 may be formed by a process of etching the mold 500 using a mask pattern 550. Thereafter, the mask pattern 550 may be removed.

Figure 9B:
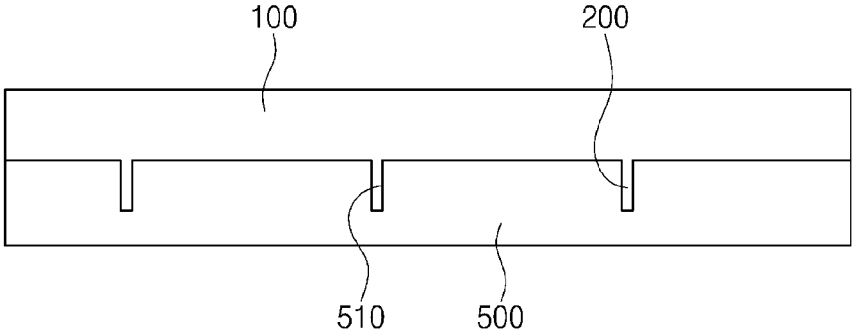

Referring to FIG. 9B, the lower substrate 100 and the structures 200 may be formed on the mold 500. For example, a polymer may be provided on the mold 500 and filled into the recessed parts 510. The polymer is cured to form the lower substrate 100 and the structures 200. Like a bolt and a nut, each of the structures 200 may have a shape corresponding to each of the recessed parts 510. The structures 200 may be the same as that described in FIG. 2B. For example, the structures 200 may protrude from the lower substrate 100. Thereafter, the lower substrate 100 and the structures 200 may be separated from the mold 500.

Figure 9C:
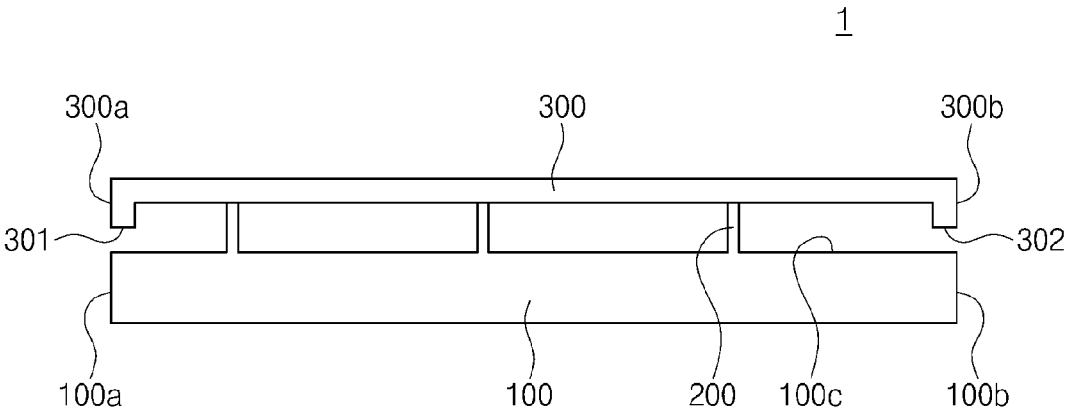

Referring to FIGS. 9C and 9B together, the lower substrate 100 may be upside down so that the structures 200 face upward. The upper substrate 300 may be aligned with the lower substrate 100 on the structures 200. The process of manufacturing the cell capturing cartridge 1 of FIG. 2B may be completed by the manufacturing example described above.

According to the embodiment of the inventive concept, the structures constituting one of the rows may be offset from the structures constituting the neighboring row in the first direction. The capturing parts of the structures in the n+1-th row may be aligned with the passages in the n-th rows (here, n is a natural number). The capturing parts of the structures may capture the cells passing through the passages with high probability.

Each of the second side surfaces of the structures may have the width greater than that of each of the first side surfaces thereof. Each of the outlets of the passages may have the width less than that of each of the inlets thereof. The cells passing through the outlets of the passages in the 1-th row may be more concentrated on the capturing parts in the n+1-th row. Thus, the capturing parts of the structures may capture the cells with higher possibility.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A cell capturing cartridge comprising:
- a lower substrate having one side, the another side disposed opposite to the one side, and an upper surface connecting the one side to the another side;
- a structure provided on the upper surface of the lower substrate and having a first side surface facing the one surface of the lower substrate and a second side surface disposed opposite to the first side surface and having a width greater than that of the first side surface; and
- an upper substrate provided on the structure,
- wherein the structure comprises:
  - first structures arranged in a first direction parallel to the one side of the lower substrate; and
  - a second structure that is offset from one of the first structures in the first direction, and
  - the first structures are disposed closer to the one side of the lower substrate than the second structure,
  - wherein the structure comprises a capturing part recessed from the first side surface to the second side surface thereof,
  - wherein the capturing part comprises:
    - a first portion disposed adjacent to the first side surface; and
    - a second portion connected to the first portion
  - wherein a width of the second portion is greater than a width of the first portion.

2. The cell capturing cartridge of claim 1, wherein the first structures have a passage therebetween, the capturing part of the second structure is aligned with the passage in a second direction, and the second direction crosses the first direction.

3. The cell capturing cartridge of claim 1, wherein the structure protrudes from the lower substrate and comprises the same material as that of the lower substrate.

4. The cell capturing cartridge of claim 1, wherein the structure protrudes from the upper substrate and comprises the same material as that of the upper substrate.

5. The cell capturing cartridge of claim 1, wherein the upper substrate has an inlet opening at a first side thereof, and the first side of the upper substrate overlaps the one side of the lower substrate in view of a plane.

6. The cell capturing cartridge of claim 1, wherein each of the structures comprises a channel, and the channel connects an inner surface of the recessed part to the linear second side surface.

7. The cell capturing cartridge of claim 6, wherein the channel has a width smaller than that of the first portion.

8. The cell capturing cartridge of claim 1, wherein each of the structures further comprises a capturing part on the second side surface, and the capturing part is recessed from the second side surface to the first side surface.

9. The cell capturing cartridge of claim 1, wherein the structure comprises a channel and the channel connects an inner surface of the capturing part to the second side surface.

10. The cell capturing cartridge of claim 9, wherein a width of the channel is smaller than the width of the first portion.

11. The cell capturing cartridge of claim 9, wherein a width of the channel is smaller than the width of the second portion.

12. A cell capturing cartridge comprising:

a substrate; and structures provided on an upper surface of the substrate and constituting a plurality of rows that are parallel to a first direction, wherein the structures in one row are offset from the structures in the neighboring rows in the first direction, the substrate has one side parallel to a row direction and the another side disposed opposite to the one side, and the upper surface connects the one side to the another side, and each of the structures comprises:

a first side surface facing the one side of the substrate; and a second side surface disposed opposite to the first side surface and having a width greater than that of the first side surface, wherein each of the structures has a recessed part in the first side surface thereof, wherein the recessed part comprises:

a first portion disposed adjacent to the first side surface; and a second portion connected to the first portion and having a width greater than that of the first portion.

13. The cell capturing cartridge of claim 12, wherein the structures in one of the rows have a passage therebetween, the structures in the neighboring row are aligned with the passage in a second direction, and the second direction crosses the first direction.

14. The cell capturing cartridge of claim 12, wherein a distance between two neighboring rows of the rows is different from that between other two neighboring rows.

* * * * *